US011740006B2

(12) United States Patent
Cooper et al.

(10) Patent No.: US 11,740,006 B2
(45) Date of Patent: Aug. 29, 2023

(54) LATCHING ASSEMBLIES FOR DOOR-IN-DOOR REFRIGERATOR APPLIANCES

(71) Applicant: Haier US Appliance Solutions, Inc., Wilmington, DE (US)

(72) Inventors: Anthony Austin Cooper, La Grange, KY (US); Jonathan Charles Crosby, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 831 days.

(21) Appl. No.: 16/687,918

(22) Filed: Nov. 19, 2019

(65) Prior Publication Data

US 2021/0148626 A1 May 20, 2021

(51) Int. Cl.
*F25D 23/02* (2006.01)
*E05C 7/02* (2006.01)

(52) U.S. Cl.
CPC ..... *F25D 23/025* (2013.01); *E05C 7/02* (2013.01); *F25D 23/028* (2013.01); *E05Y 2900/31* (2013.01); *F25D 2323/023* (2013.01)

(58) Field of Classification Search
CPC ..... F25D 23/025; F25D 23/028; F25D 2323/023; E05C 7/02; E05C 3/30; E05C 3/16; E05C 3/124; E05Y 2900/31; E05B 1/0015; E05B 1/0038; E05B 65/0042
See application file for complete search history.

(56) References Cited

U.S. PATENT DOCUMENTS

| | | | | |
|---|---|---|---|---|
| 2,469,113 | A * | 5/1949 | Hooker | E05B 65/0046 292/DIG. 59 |
| 2,639,182 | A * | 5/1953 | Jacobson | E05B 65/0042 292/332 |
| 9,605,891 | B2 * | 3/2017 | Lee | F25D 23/02 |
| 10,087,658 | B2 | 10/2018 | Gresham, IV et al. | |
| 10,203,148 | B2 | 2/2019 | Lee et al. | |
| 2008/0296915 | A1 * | 12/2008 | Clark | E05C 19/163 292/251.5 |
| 2013/0119845 | A1 * | 5/2013 | Seo | F25D 23/04 312/405.1 |
| 2015/0069900 | A1 * | 3/2015 | Lim | F25D 23/028 312/405 |
| 2015/0241116 | A1 * | 8/2015 | Choi | F25D 23/00 312/405 |
| 2016/0138855 | A1 | 5/2016 | Choo et al. | |
| 2016/0195326 | A1 * | 7/2016 | Lim | F25D 23/028 312/405.1 |

(Continued)

*Primary Examiner* — Hiwot E Tefera
(74) *Attorney, Agent, or Firm* — Dority & Manning, P.A.

(57) ABSTRACT

A latching assembly for a refrigerator appliance having inner and outer doors includes a catch and a latch. The latch is operable to engage the catch. As a result of such engagement, the inner and outer doors are latched together when the latch is engaged with the catch. The latching assembly also includes a trigger connected to the latch. The trigger is movable within a plane perpendicular to the vertical direction from a first position to a secondary position. The latch moves within the plane perpendicular to the vertical direction when the trigger moves to the secondary position. As a result, the latch is disengaged from the catch by moving the trigger within the plane perpendicular to the vertical direction to the secondary position.

18 Claims, 8 Drawing Sheets

(56) References Cited

U.S. PATENT DOCUMENTS

| | | | | |
|---|---|---|---|---|
| 2017/0051542 | A1* | 2/2017 | Reske | E05B 63/244 |
| 2017/0175423 | A1* | 6/2017 | Gresham, IV | F25D 23/025 |
| 2018/0156529 | A1* | 6/2018 | Wantland | F25D 23/025 |
| 2019/0032993 | A1* | 1/2019 | Wantland | F25D 23/028 |
| 2019/0120542 | A1 | 4/2019 | Kim et al. | |
| 2019/0338999 | A1* | 11/2019 | Lee | E05B 63/248 |
| 2021/0239386 | A1* | 8/2021 | Yoon | E05C 3/162 |

* cited by examiner

LATCHING ASSEMBLIES FOR DOOR-IN-DOOR REFRIGERATOR APPLIANCES

FIELD OF THE INVENTION

The subject matter of the present disclosure relates generally to refrigerator appliances. In particular, the present subject matter relates to latching assemblies for door-in-door refrigerator appliances.

BACKGROUND OF THE INVENTION

Refrigerator appliances generally include a cabinet that defines a food storage chamber. In addition, refrigerator appliances also generally include a door rotatably hinged to the cabinet to permit selective access to food items stored in the food storage chamber. Certain refrigerator appliances, commonly referred to as door-in-door refrigerator appliances, may also include an outer door rotatably hinged to the inner door to permit selective access to the food storage chamber or a food storage chamber positioned between the inner and outer doors. In addition, door-in-door appliances may also include a gasket positioned on the outer door. Thus, when the outer door is in the closed position, the gasket seals against the inner door to enclose the food storage chamber.

Door-in-door refrigerator appliances also generally include a latching mechanism that allows a user to latch the inner and outer door together. The latching mechanism generally includes a latch positioned on the outer door and a mating catch positioned on the inner door. In operation, the latch engages the catch to latch the outer door to the inner door. However, some latches can be difficult to unlatch, not convenient to access, and/or prone to unintentional unlatching.

Accordingly, a door-in-door refrigerator appliance having a latching assembly with improved actuating features would be useful.

BRIEF DESCRIPTION OF THE INVENTION

Aspects and advantages of the invention will be set forth in part in the following description, or may be apparent from the description, or may be learned through practice of the invention.

In one embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The refrigerator appliance also includes inner and outer doors. The inner door is rotatably hinged to the cabinet and movable between an open position and a closed position to permit selective access to the food storage chamber. The outer door is rotatably hinged to the inner door and is movable between an open position and a closed position. The refrigerator appliance may also include a latching assembly for securing the outer door in the closed position. The latching assembly includes a catch and a latch. The latch is operable to engage the catch. As a result of such engagement, the outer door is secured in the closed position when the latch is engaged with the catch. The latching assembly also includes a trigger connected to the latch. The trigger is movable within a plane perpendicular to the vertical direction from a first position to a secondary position. The latch moves within the plane perpendicular to the vertical direction when the trigger moves to the secondary position. As a result, the latch is disengaged from the catch by moving the trigger within the plane perpendicular to the vertical direction to the secondary position.

In another embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber includes an opening positioned at a front portion of the food storage chamber. A nesting door assembly is mounted at the front portion of the cabinet. The nesting door assembly includes an inner door, an outer door, and a latching assembly operable to selectively latch the inner door and the outer door together and unlatch the inner door and the outer door to permit each door to move independently of the other. The inner door is movable between an open position and a closed position to permit selective access to the food storage chamber. The outer door is movable between an open position and a closed position to permit selective access to a portion of the food storage chamber. The latching assembly includes a catch and a latch. The latch is operable to engage the catch. As a result of such engagement, the outer door is secured in the closed position when the latch is engaged with the catch. The latching assembly also includes a trigger connected to the latch. The trigger is movable within a plane perpendicular to the vertical direction from a first position to a secondary position. The latch moves within the plane perpendicular to the vertical direction when the trigger moves to the secondary position. As a result, the latch is disengaged from the catch by moving the trigger within the plane perpendicular to the vertical direction to the secondary position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
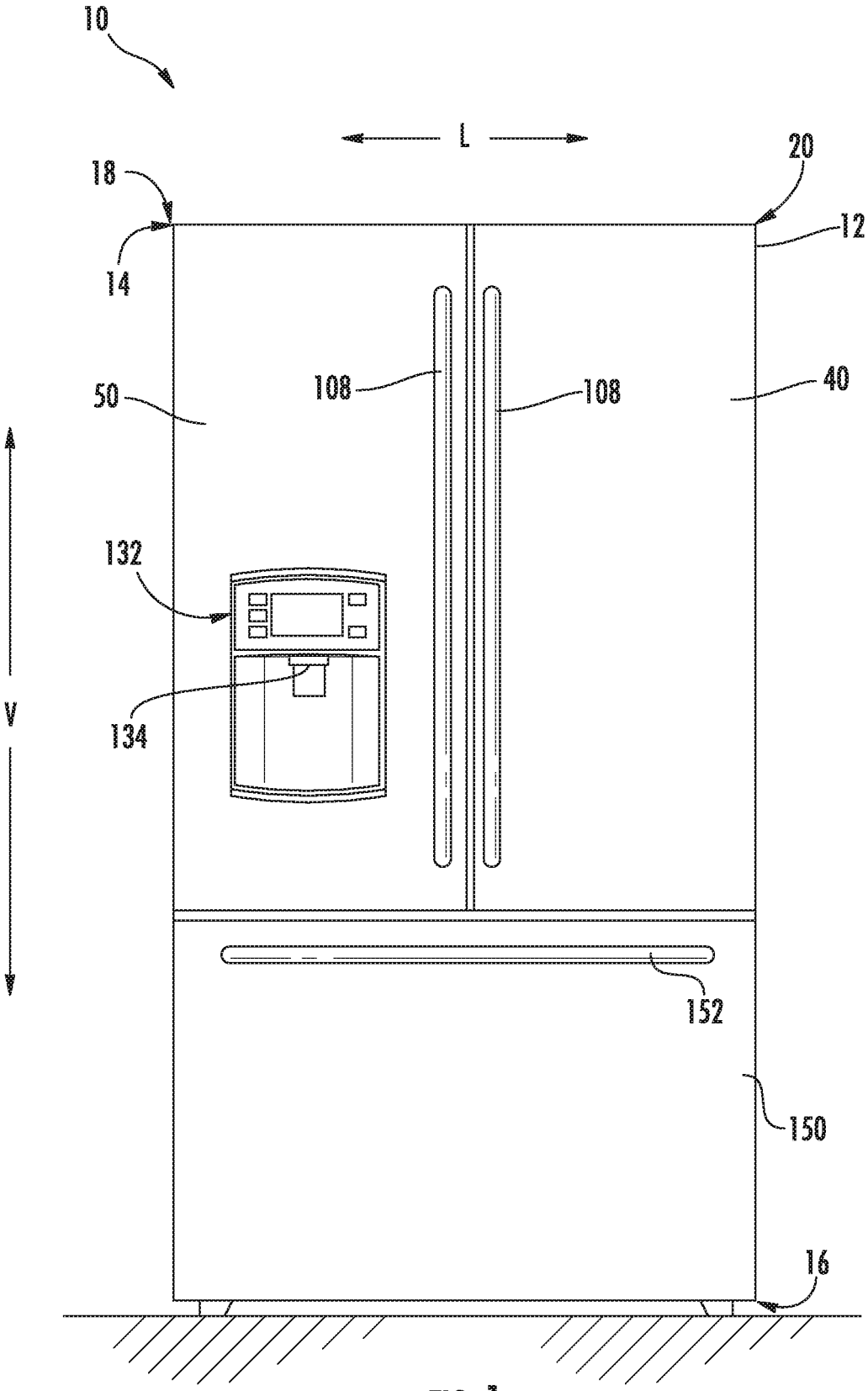
FIG. 1 provides a front elevation view of a refrigerator appliance according to one or more example embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Figure 2:
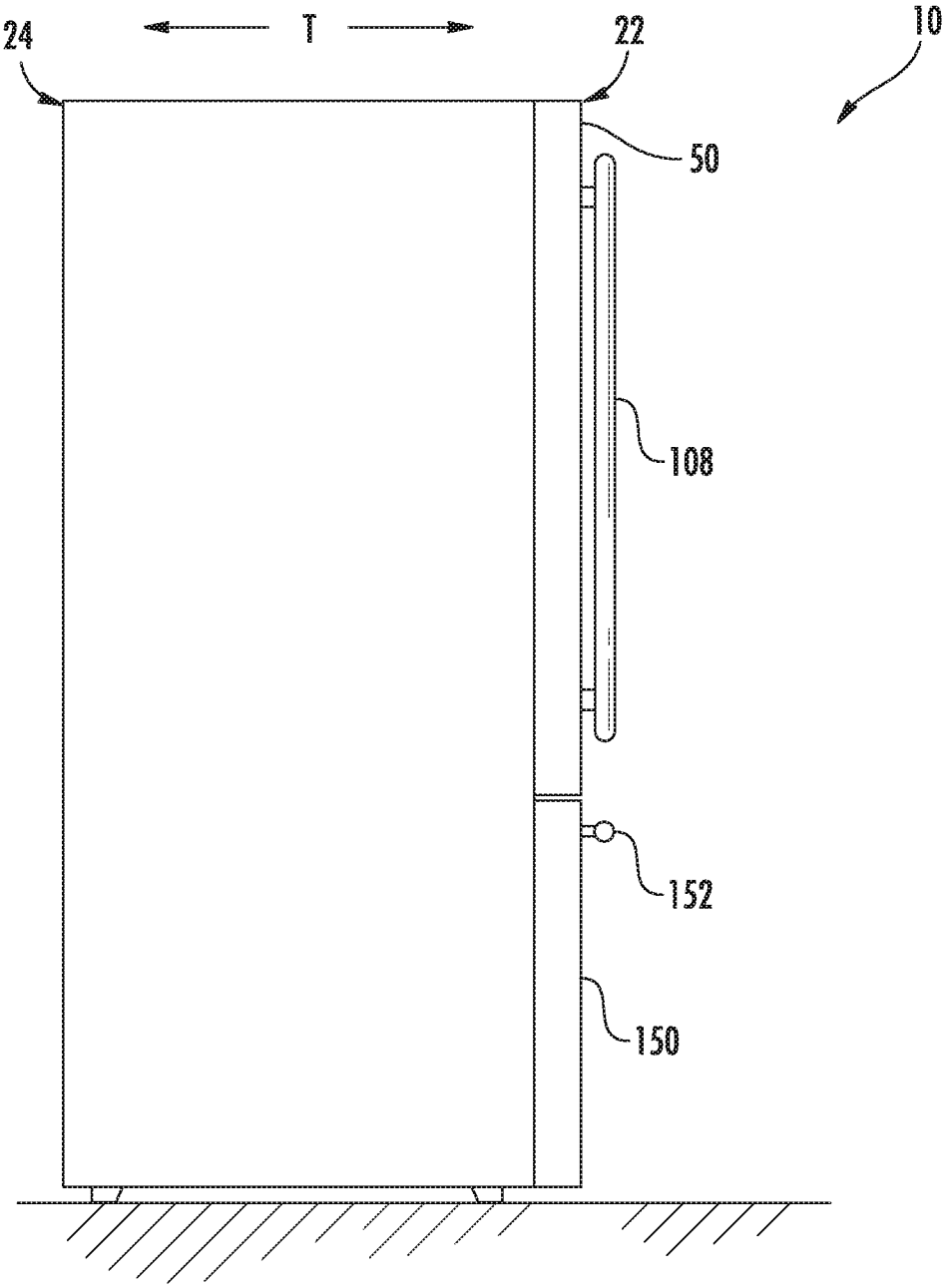
FIG. 2 provides a side view of the refrigerator appliance of FIG. 1.
Figure 3:
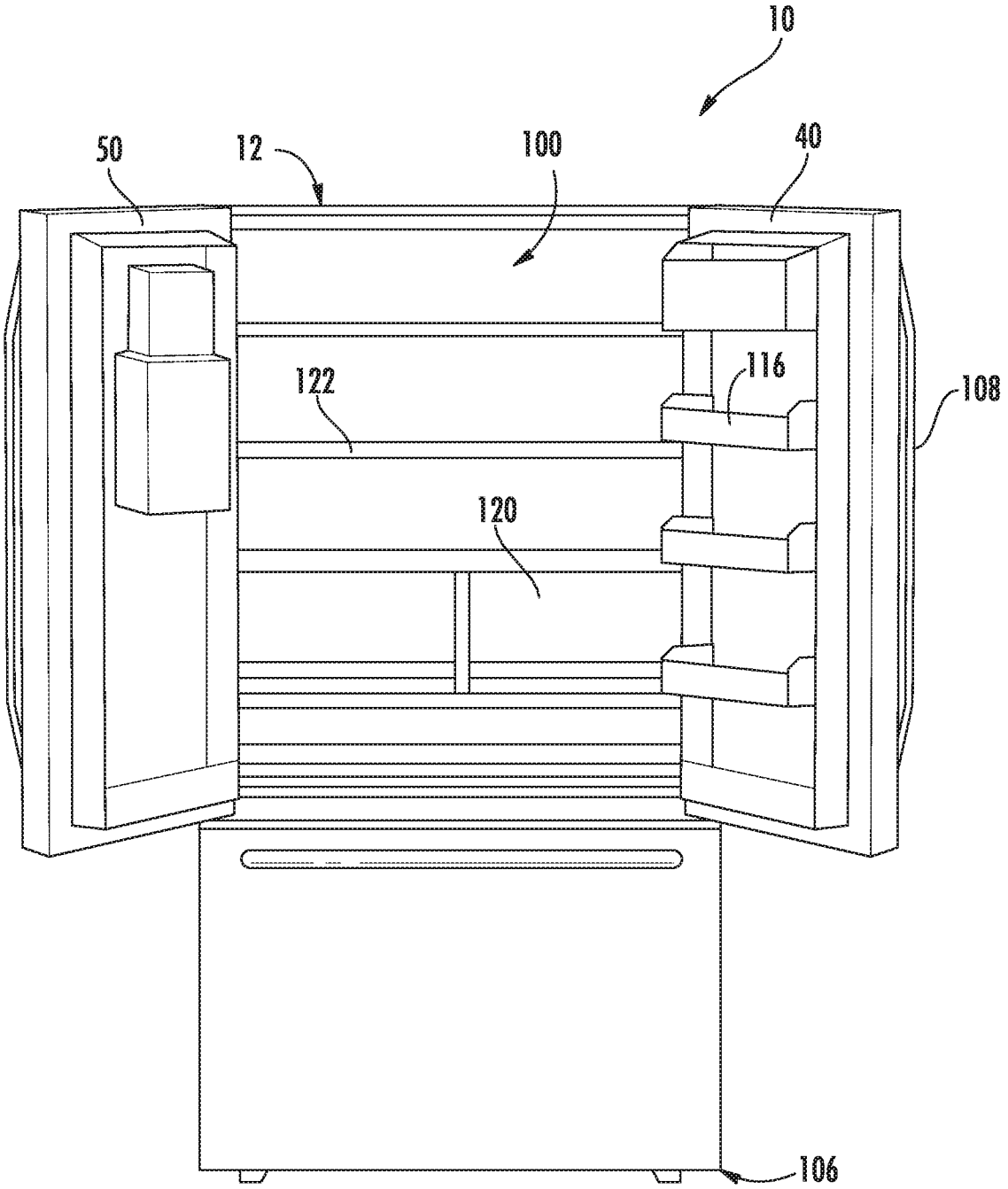
FIG. 3 provides a front view of the refrigerator appliance of FIG. 1 with doors of the exemplary refrigerator appliance shown in an open position.

Referring now to FIGS. 1-3, a refrigerator appliance 10 according to an embodiment of the present subject matter defines a vertical direction V, a lateral direction L, and a transverse direction T (see, e.g., FIG. 2), each mutually perpendicular to one another. As may be seen, the refrigerator appliance 10 includes a housing or cabinet 12 that extends between a top 14 and a bottom 16 along the vertical direction V, between a left side 18 and a right side 20 along the lateral direction L, and between a front side 22 and a rear side 24 along the transverse direction T (see, e.g., FIG. 2).

The cabinet 12 defines a food storage chamber 100 (FIG. 3) for receipt of food items for storage. In particular, the food storage chamber 100 is positioned at or adjacent the top 14 of the cabinet 12. It should be appreciated, however, that the food storage chamber 100 may be positioned at any suitable location within the refrigerator appliance 10. For example, in one embodiment, the food storage chamber 100 may extend from top 14 to bottom 16 along the vertical direction V.

The refrigerator appliance 10 may include refrigerator doors 40, 50 rotatably mounted to the cabinet, e.g., such that the refrigerator doors 40, 50 permit selective access to the food storage chamber 100. As shown, the refrigerator doors 40, 50 include a right refrigerator door 40 and a left refrigerator door 50. The right refrigerator door 40 may be rotatably mounted to the cabinet 12 at the right side 20 of the cabinet 12. The left refrigerator door 50 may be rotatably mounted to the left side 18 of the cabinet 12. As shown, a handle 108 may be positioned on each of the refrigerator doors 40, 50 to facilitate movement of the doors 40, 50 between a closed position (FIG. 1) and an open position (FIG. 3).

The refrigerator appliance 10 may also include a dispenser assembly 132 for dispensing liquid water and/or ice. The dispenser assembly 132 includes a dispenser 134 positioned on or mounted to an exterior portion of the refrigerator appliance 10, e.g., on the left refrigerator door 50. In addition, the refrigerator appliance 10 may include a freezer drawer 150 arranged below the refrigerator doors 40, 50 for selectively accessing items a frozen food storage chamber (not shown). The freezer drawer 150 includes a handle 152, and is slidably mounted to the cabinet 12. Accordingly, the freezer drawer 150 may be moved in and out of the frozen food storage chamber (not shown) along the transverse direction T.

As shown in FIG. 3, various storage components are mounted within the food storage chamber 100 to facilitate storage of food items therein as will be understood by those skilled in the art. In particular, the storage components include bins 116, drawers 120, and shelves 122 that are mounted within the fresh food chamber 100. The bins 116, drawers 120, and shelves 122 are configured for receipt of food items (e.g., beverages and/or solid food items) and may assist with organizing such food items.

Figure 5:
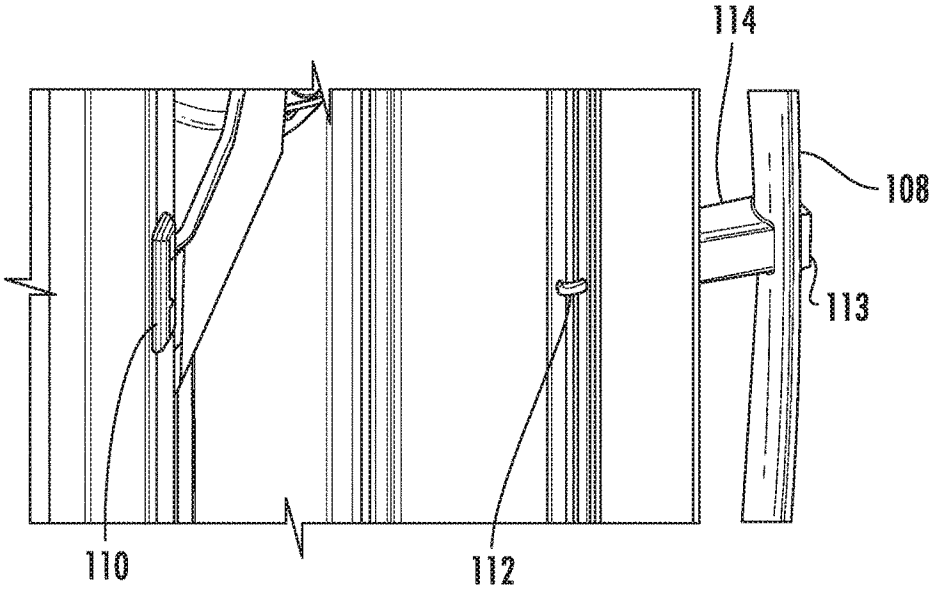
FIG. 5 provides an enlarged view of a portion of FIG. 4 including an exemplary latch.
Figure 4:
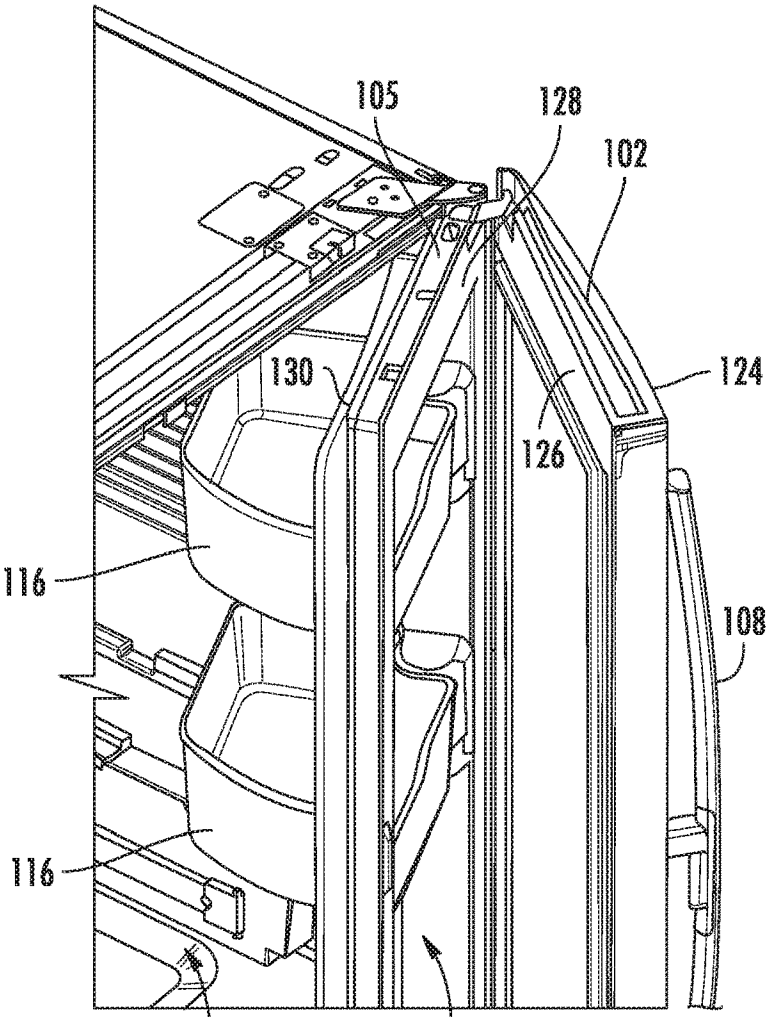
FIG. 4 provides a perspective view of a portion of a refrigerator appliance with the doors of the exemplary refrigerator appliance in an unlatched position in accordance with one or more example embodiments of the present subject matter.
Figure 6:
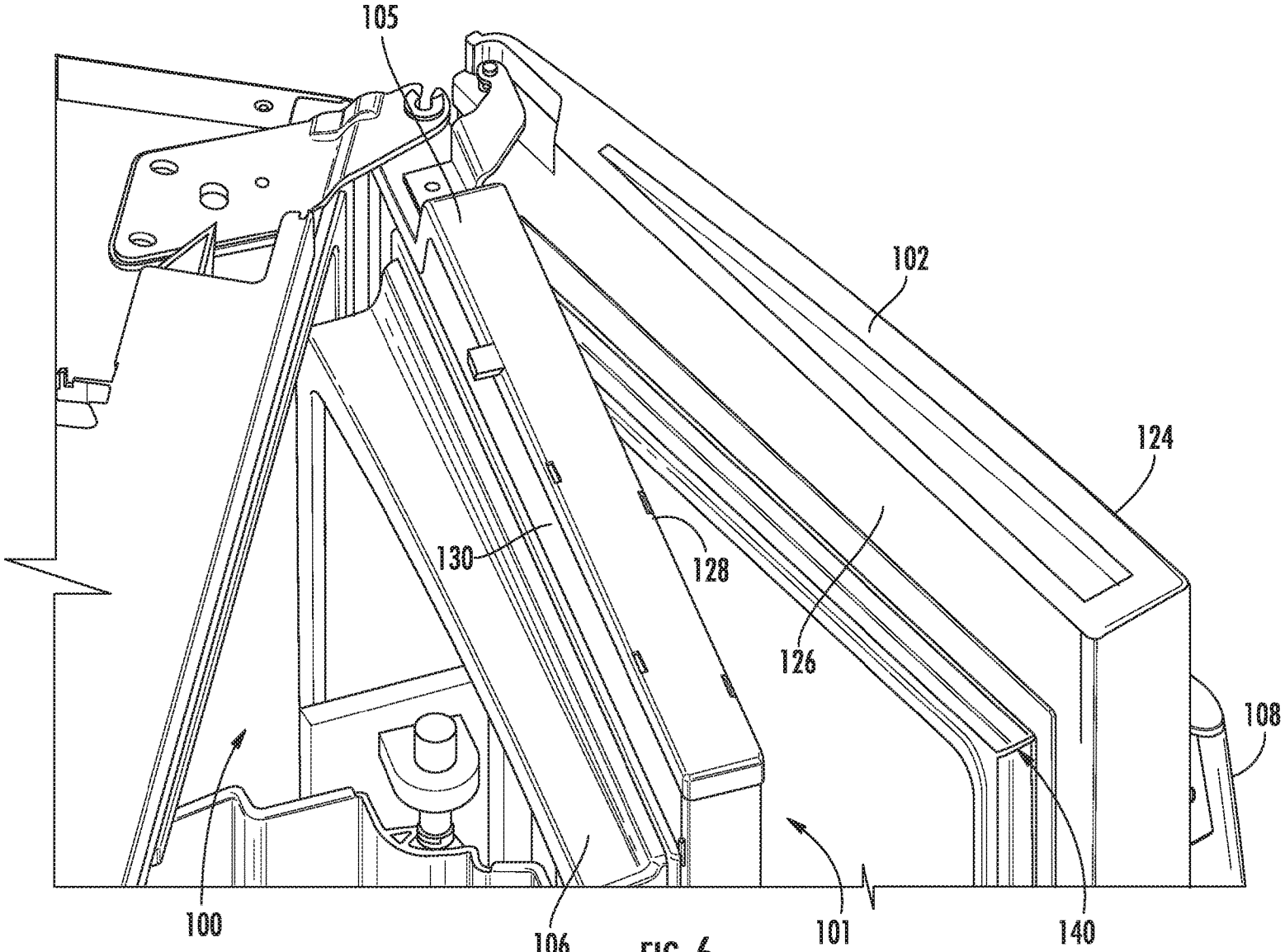
FIG. 6 provides another perspective view of an exemplary refrigerator appliance with the doors of the exemplary refrigerator appliance in an unlatched position.

Referring now to FIGS. 4-6, the refrigerator appliance 10 may be configured as a door-in-door refrigerator. In particular, the right refrigerator door 40 may be or include a nested door assembly comprising an outer door 102 and an inner door 105. In an alternative embodiment, the left refrigerator door 50 may be or include the nested door assembly. In another alternative embodiment, both refrigerator doors 40, 50 may be or include the nested door assembly.

The inner door 105 may include an outer surface 128 and an opposing inner surface 130, and the inner door 105 may be rotatably hinged to the cabinet 12, e.g., such that the inner door 105 is movable between a closed position and an open position (FIG. 4 illustrates an intermediate position between the closed position of FIG. 1 and the open position of FIG. 3) to permit selective access to the food storage chamber 100 of the cabinet 12. In particular, the inner door 105 may be mounted to the cabinet 12 at the right side 20 of the cabinet 12. The inner door 105 may define an opening extending through the outer and inner surfaces 128, 130 and into the food storage chamber 100. In addition, the inner door 105 may include a frame 106 (FIG. 6). As shown, the frame 106 may be positioned on the interior surface 130 of the inner door 105, and the frame 106 may extend around a perimeter of the opening defined by the inner door 105. In addition, the frame 106 may extend into the fresh food storage chamber 100 when the inner door 105 is in the closed position.

The outer door 102 of the nested door assembly may include an outer surface 124 and an opposing inner surface 126. As shown, the outer door 102 may be rotatably hinged to the inner door 105, and the outer door 102 may be movable between a closed position, where the outer door 102 abuts the inner door 105 and/or is sealingly engaged with the inner door 105, such as via the gasket 140 described below, and an open position. In some embodiments, the outer door 102 is movable to permit selective access to a portion of the food storage chamber 100 through the opening defined by the inner door 105. In some embodiments, a portion of the outer door 102 can be received within the frame 106 of the inner door 105 to define a second food storage chamber 101. In particular, the second food storage chamber 101 may be contiguous with the food storage chamber 100. It should be appreciated, however, that the second food storage chamber 101 may be isolated from the food storage chamber 100. For example, the second storage chamber 101 may be a cavity defined in the outer surface 128 of the inner door 105. In particular, the cavity may not extend through the inner surface 130 of the inner door 105 and, as a result, may be isolated from the food storage chamber 100.

It should be appreciated that the outer and inner doors 102, 105 move in the same direction when latched together, as will be described in more detail below. For example, the outer and inner doors 102, 105 may each move away from the food storage chamber 100 when moving towards the open position. In contrast, the outer and inner doors 102, 105 may each move towards the food storage chamber 100 when moving towards the closed position. Further, unlatching the inner and outer doors 102 and 105 permits each door 102 and 105 to move independently of the other.

The refrigerator appliance 10 may also include a gasket 140 positioned on the inner surface 126 of the outer door 102. As the outer door 102 moves towards the closed position, the outer door 102 may compress the gasket 140 against the outer surface 128 of the inner door 105. More specifically, the gasket 140 may seal against the outer surface 128 of the inner door to enclose the food storage chamber 100 or, alternatively, the second food storage chamber 101. In an alternative embodiment, the gasket 140 may be positioned on the outer surface 128 of the inner door 105 and, as the outer door 102 moves towards the closed position, the inner door 105 may compress the gasket 140 against the inner surface 126 of the outer door 102. More specifically, the gasket 140 may seal against the inner surface 126 of the outer door 102. It should be appreciated that the gasket 140 may be comprised of any suitable material. For example, in one embodiment, the gasket 140 may be comprised of rubber.

The refrigerator appliance 10 may also include a latching assembly to latch the outer and inner doors 102, 105 together, e.g., for securing the outer door 102 in the closed position. As shown in FIGS. 4 and 5, the latching assembly may include a catch 110 and a latch 112. In some embodiments, the catch 112 may be provided on the inner door 105 and the latch 112 may be provided on the outer door 102. In addition, a handle 108 positioned on the outer door 102 may include a trigger 113 connected to, e.g., operably coupled with, the latch 112. For example, the trigger 113 and the latch 112 may be separate pieces connected together at a joint, such as a pivot joint, a snap-fit joint, etc. As another example, the trigger 113 and the latch 112 may be connected by integrally joining or integrally forming the trigger 113 and the latch 112. In addition, a latch housing 114 may be mounted to the handle 108, and the latch 112 may, at least in part, be positioned within the latch housing 114. The latch 112 may be operable to engage the catch 110 such that the outer door 102 is secured to the inner door 105, e.g., the outer door 102 is in the closed position, when the latch 112 is engaged with the catch 110.

In operation, a user may grasp the handle 108 of the outer door 102, actuate the trigger 113 to release the latch 112 from the catch 110 and thereby unlatch the outer door 102 from the inner door 105. When the outer door 102 is unlatched from the inner door 105, the outer door 102 may rotate independent of the inner door 105. As such, a user may access the bins 116 without opening the inner door 105. Alternatively, operating the handle 108 without actuating the trigger 113 permits opening the outer door 102 and the inner door 105 together for full access to the food storage chamber 100.

Figure 7:
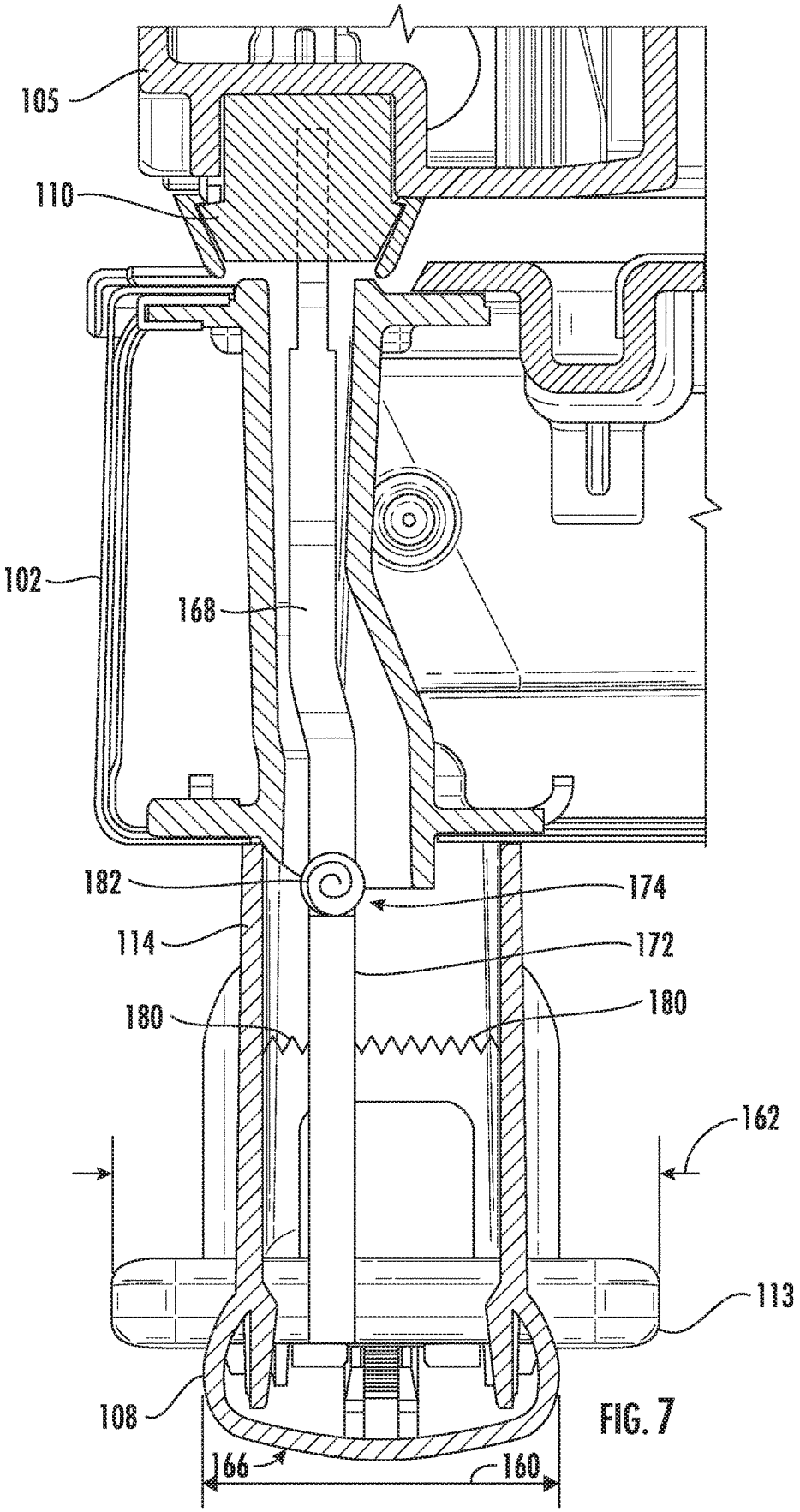
FIG. 7 provides a section view taken in a plane perpendicular to the vertical direction of an exemplary latching assembly according to one or more exemplary embodiments of the present disclosure.
Figure 8:
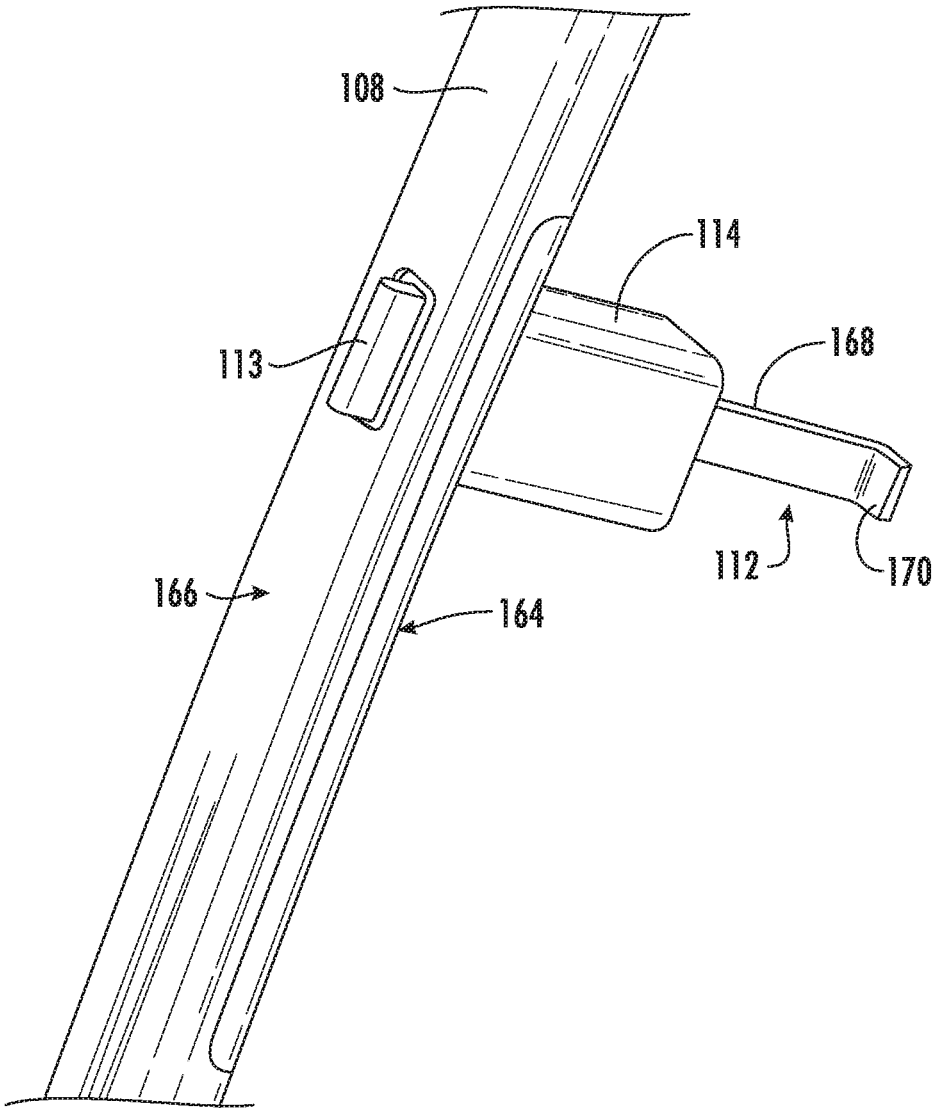
FIG. 8 provides a perspective view of a latch in accordance with one or more additional example embodiments of the present disclosure.
Figure 9:
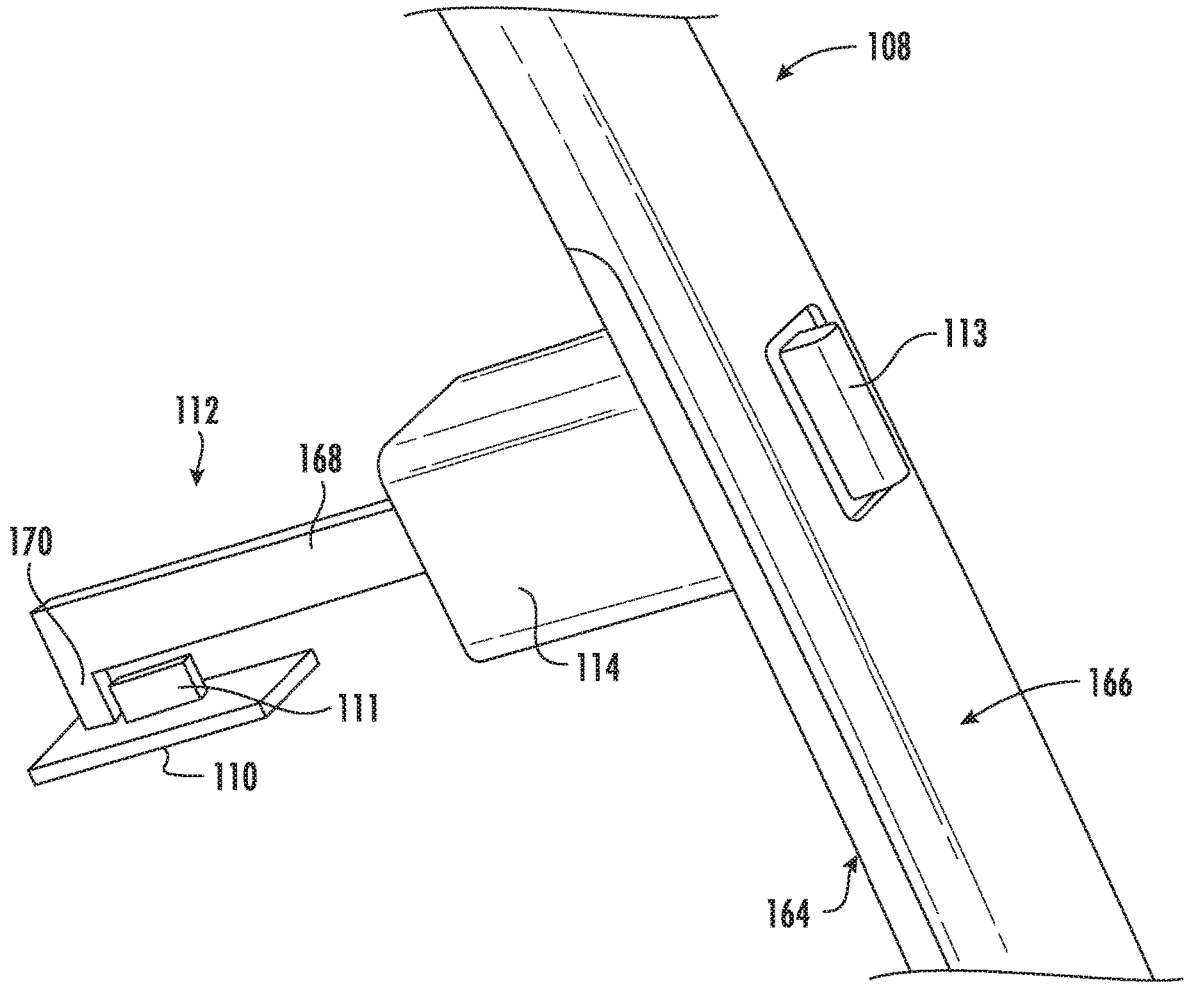
FIG. 9 provides a perspective view of a latch in accordance with one or more further example embodiments of the present disclosure.

Referring now to FIGS. 7-9, additional details of exemplary embodiments of the latching assembly are illustrated. As generally seen throughout the FIGS., the trigger 113 may, in various exemplary embodiments, be movable within a plane perpendicular to the vertical direction V from a first position to a secondary position and/or a tertiary position and, with the latch 112 coupled to the trigger 113, such movement of the trigger 113 to the secondary and/or tertiary position causes the latch 112 to move away from the catch 110 such that the latch 112 is disengaged from the catch 110 by moving the trigger 113 within the plane perpendicular to the vertical direction V to the secondary position or the tertiary position. The latch 112 also moves within the plane perpendicular to the vertical direction V when the trigger 113 moves to the secondary position or the tertiary position. For example, FIG. 7 is a section through the handle 108 and the latching assembly in a plane perpendicular to the vertical direction V. When the inner door 105 is in the closed position, then the transverse direction T will extend from top to bottom on the page in FIG. 7 and the lateral direction L will extend horizontally on the page in FIG. 7. FIGS. 7 and 9 depict the latch 112 in an engaged position, e.g., engaged with the catch 110, whereby the nested door assembly is latched, as described above. In particular, as best seen in FIG. 9 where a portion of the catch 110 is removed to more clearly illustrate internal components thereof, the catch 110 may include a projection or tab 111 which is engaged with, e.g., hooked by, the latch 112 when in the engaged position. When the latch 112 is in the engaged position, the trigger 113 is in the first position, which may be a centered position, e.g., as illustrated in FIGS. 7 and 9. In embodiments where the first position of the trigger 113 is the centered position, the trigger 113 may be movable within the plane perpendicular to the vertical direction V in either a first direction or a second direction opposite the first direction to disengage the latch 112 from the catch 110. For example, the trigger 113 may be movable within the plane perpendicular to the vertical direction V from the first position to the secondary position in the first direction, and the trigger may be movable within the plane perpendicular to the vertical direction V from the first position to a tertiary position in the second direction.

In various embodiments, the trigger 113 may be visible from the front of the refrigerator appliance 10. Such embodiments may prevent or minimize accidental actuation of the trigger 113, where a user standing in front of the refrigerator appliance 10 may be able to see the trigger 113, which makes it easier to actuate the trigger 113 when desired and/or to avoid actuating the trigger 113 when not intended. For example, as may be seen in FIG. 7, in some embodiments, the handle 108 may define a first width 160 within the plane perpendicular to the vertical direction V and the trigger 113 may define a second width 162 parallel to the first width 160. Where the second width 162 of the trigger 113 is greater than the first width 160 of the handle 108, the trigger 113 may be more readily perceptible by a user, e.g., even when the trigger 113 is behind the handle 108 as illustrated in FIG. 7. In some embodiments, the handle 108 may define an inner surface 164 facing the cabinet 12 and an outer surface 166 which is opposite the inner surface 164 and faces away from the cabinet 12. In some embodiments, e.g., as illustrated in FIGS. 8 and 9, the trigger 113 may be disposed on the outer surface 166 of the handle 108. In such embodiments, the trigger 113 may thus be more readily perceptible because it is on a forward-facing or outward-facing surface.

As best seen in FIGS. 8 and 9, the latch 112 generally includes an arm 168 and a hook 170 at an end of the arm 168. In some embodiments, the hook 170 may be oriented along the vertical direction V, such as upward along the vertical direction V, e.g., towards the top 14 of the cabinet 12, as illustrated in FIG. 5, or downward along the vertical direction V, e.g., towards the bottom 16 of the cabinet 12, as illustrated in FIG. 9. In other embodiments, the hook 170 may be oriented at an angle to the vertical direction V, e.g., perpendicular to the vertical direction V, for example as illustrated in FIG. 8. In embodiments where the hook 170 is oriented along a direction perpendicular to the vertical direction V, the hook 170 may be oriented along the lateral direction L when the nested door assembly is in the closed position, e.g., when both of the inner door 105 and the outer door 102 are each in the respective closed positions described above.

In various embodiments, the latching assembly may also include a biasing member coupled to the latch 112. For example, in some embodiments, the biasing member may be coupled directly to the arm 168 of the latch 112. In other embodiments, the biasing member may be directly coupled to a link arm 172 which is directly connected to the trigger 113, e.g., as illustrated in FIG. 7 where the biasing member includes at least one coil spring 180, such that the biasing member is indirectly coupled to the latch 112. The biasing member may be configured to bias the latch 112 into engagement with the catch 110. For example, the biasing member may be configured to bias the trigger 113 to the first position. In embodiments where the first position is a centered position, e.g., as illustrated in FIG. 7, the latching assembly may include a first biasing member and a second biasing member opposite the first biasing member, such as the first and second coil springs 180 illustrated in FIG. 7, where the first biasing member may, for example, be configured to bias the trigger 113 from the secondary position to the first position and the second biasing member may, for example, be configured to bias the trigger 113 from the tertiary position to the first position. In some embodiments, the biasing member may be a compression spring, e.g., a helical coil spring or springs 180 as illustrated in FIG. 7, or a leaf spring, or other compression spring. In other embodiments, the biasing member may be a torsion spring 182. For example, also as illustrated in FIG. 7, the latch 112 may include a first arm, e.g., link arm 172, directly connected to the trigger 113 and a second arm, e.g., arm 168, connected to the first arm at a pivot joint 174. In such embodiments, the biasing member may be a torsion spring 182 coupled to the pivot joint 174 (and indirectly coupled to the latch 112 via the pivot joint 174). In such embodiments, the torsion spring 182 may be configured to bias the arm 168 and the hook 170 thereon into engagement with the catch 110.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber, the cabinet extending between a top and a bottom along the vertical direction;

an inner door rotatably hinged to the cabinet, the inner door movable around the vertical direction between an open position and a closed position to permit selective access to the food storage chamber;

an outer door rotatably hinged to the inner door, the outer door movable around the vertical direction between an open position and a closed position;

a handle mounted on the outer door, wherein the handle defines an inner surface facing the cabinet and an outer surface opposite the inner surface and facing away from the cabinet; and a latching assembly for securing the outer door in the closed position, the latching assembly comprising:

a catch;

a latch operable to engage the catch whereby the outer door is secured in the closed position when the latch is engaged with the catch; and a trigger disposed on the outer surface of the handle, the trigger connected to the latch by a pivot joint defining a pivot axis oriented along the vertical direction, the trigger movable around the pivot axis defined by the pivot joint within a plane perpendicular to the vertical direction from a first position to a secondary position, wherein the latch moves around the pivot axis defined by the pivot joint within the plane perpendicular to the vertical direction when the trigger moves to the secondary position, whereby the latch is disengaged from the catch by moving the trigger within the plane perpendicular to the vertical direction to the secondary position.

2. The refrigerator appliance of claim 1, wherein the trigger is movable within the plane perpendicular to the vertical direction from the first position to the secondary position in a first direction, and the trigger is movable within the plane perpendicular to the vertical direction from the first position to a tertiary position in a second direction opposite the first direction, whereby the latch is disengaged from the catch by moving the trigger within the plane perpendicular to the vertical direction from the position to the secondary position or to the tertiary position.

3. The refrigerator appliance of claim 1, wherein the latch comprises an arm and a hook.

4. The refrigerator appliance of claim 3, wherein the hook is oriented along a direction perpendicular to the vertical direction.

5. The refrigerator appliance of claim 3, wherein the hook is oriented along the vertical direction.

6. The refrigerator appliance of claim 1, wherein the latching assembly further comprises a biasing member coupled to the latch, the biasing member configured to bias the latch into engagement with the catch.

7. The refrigerator appliance of claim 6, wherein the biasing member comprises a compression spring.

8. The refrigerator appliance of claim 1, wherein the latch comprises a first arm directly connected to the trigger, a second arm connected to the first arm at the pivot joint, a hook formed on the second arm and configured to engage the catch, and a torsion spring coupled to the pivot joint, the torsion spring configured to bias the second arm and the hook thereon into engagement with the catch.

9. A refrigerator appliance defining a vertical direction, a lateral direction, and a transverse direction, the vertical, lateral, and transverse directions being mutually perpendicular, the refrigerator appliance comprising:

a cabinet defining a food storage chamber, the cabinet extending between a top and a bottom along the vertical direction and between a front side and a rear side along the transverse direction;

the food storage chamber comprising an opening positioned at a front portion of the food storage chamber;

a nesting door assembly mounted at the front portion of the cabinet, the nesting door assembly comprising an inner door, an outer door, and a latching assembly operable to selectively latch the inner door and the outer door together and unlatch the inner door and the outer door to permit each door to move independently of the other, the inner door movable around the vertical direction between an open position and a closed position to permit selective access to the food storage chamber, the outer door movable around the vertical direction between an open position and a closed position to permit selective access to a portion of the food storage chamber, the latching assembly comprising:

a catch;

a latch operable to engage the catch whereby the outer door is secured in the closed position when the latch is engaged with the catch;

a pivot joint defining a pivot axis oriented along the vertical direction; and a trigger connected to the latch, the trigger movable around the pivot axis defined by the pivot joint within a plane perpendicular to the vertical direction to move from a first position to a secondary position, wherein the trigger is movable within the plane perpendicular to the vertical direction from the first position to the secondary position in a first direction and the trigger is movable within the plane perpendicular to the vertical direction from the first position to a tertiary position in a second direction opposite the first direction, wherein the latch moves around the pivot axis defined by the pivot joint within the plane perpendicular to the vertical direction when the trigger moves to the secondary position or to the tertiary position, whereby the latch is disengaged from the catch by moving the trigger within the plane perpendicular to the vertical direction to the secondary position or to the tertiary position.

10. The refrigerator appliance of claim 9, further comprising a handle mounted on the outer door, wherein the handle defines a first width within the plane perpendicular to the vertical direction, the trigger defines a second width parallel to the first width, and the second width is greater than the first width.

11. The refrigerator appliance of claim 9, further comprising a handle mounted on the outer door, wherein the handle defines an inner surface facing the cabinet and an outer surface opposite the inner surface and facing away from the cabinet, and wherein the trigger is disposed on the outer surface of the handle.

12. The refrigerator appliance of claim 9, wherein the latch comprises an arm and a hook.

13. The refrigerator appliance of claim 12, wherein the hook is oriented along the lateral direction.

14. The refrigerator appliance of claim 12, wherein the hook is oriented along the vertical direction.

15. The refrigerator appliance of claim 9, wherein the latching assembly further comprises a biasing member coupled to the latch, the biasing member configured to bias the latch into engagement with the catch.

16. The refrigerator appliance of claim 15, wherein the biasing member comprises a compression spring.

17. The refrigerator appliance of claim 9, wherein the latch comprises a first arm directly connected to the trigger, a second arm connected to the first arm at the pivot joint, a hook formed on the second arm and configured to engage the catch, and a torsion spring coupled to the pivot joint, the torsion spring configured to bias the second arm and the hook thereon into engagement with the catch.

18. A refrigerator appliance defining a vertical direction, a lateral direction, and a transverse direction, the vertical, lateral, and transverse directions being mutually perpendicular, the refrigerator appliance comprising:

a cabinet defining a food storage chamber, the cabinet extending between a top and a bottom along the vertical direction;

an inner door rotatably hinged to the cabinet, the inner door movable around the vertical direction between an open position and a closed position to permit selective access to the food storage chamber;

an outer door rotatably hinged to the inner door, the outer door movable around the vertical direction between an open position and a closed position; and a latching assembly for securing the outer door in the closed position, the latching assembly comprising:

a catch;

a latch operable to engage the catch whereby the outer door is secured in the closed position when the latch is engaged with the catch; and a trigger connected to the latch by a pivot joint defining a pivot axis oriented along the vertical direction, the trigger movable around the pivot axis defined by the pivot joint within a plane perpendicular to the vertical direction from a first position to a secondary position, wherein the trigger is movable within the plane perpendicular to the vertical direction from the first position to the secondary position in a first direction, and the trigger is movable within the plane perpendicular to the vertical direction from the first position to a tertiary position in a second direction opposite the first direction, wherein the latch moves around the pivot axis defined by the pivot joint within the plane perpendicular to the vertical direction when the trigger moves to the secondary position or to the tertiary position, whereby the latch is disengaged from the catch by moving the trigger within the plane perpendicular to the vertical direction to the secondary position or to the tertiary position.

* * * * *